US007415974B2

(12) United States Patent
Akiba et al.

(10) Patent No.: US 7,415,974 B2
(45) Date of Patent: Aug. 26, 2008

(54) FUEL FEED APPARATUS HAVING SUB-TANK

(75) Inventors: Takashi Akiba, Anjo (JP); Hiroto Inoue, Wako (JP); Akira Isayama, Wako (JP); Naritoshi Muramatsu, Wako (JP)

(73) Assignee: Denso Corporation (JP)

( * ) Notice: Subject to any disclaimer, the term of this patent is extended or adjusted under 35 U.S.C. 154(b) by 75 days.

(21) Appl. No.: 11/496,709

(22) Filed: Aug. 1, 2006

(65) Prior Publication Data

US 2007/0044773 A1 Mar. 1, 2007

(30) Foreign Application Priority Data

Aug. 31, 2005 (JP) ..... 2005-251333

(51) Int. Cl.
*F02M 37/04* (2006.01)
*F02M 37/08* (2006.01)

(52) U.S. Cl. ..... 123/509; 123/511

(58) Field of Classification Search ..... 123/509, 123/510, 511, 495, 497; 137/572
See application file for complete search history.

(56) References Cited

U.S. PATENT DOCUMENTS 5,960,817 A * 10/1999 Johansen et al. ..... 137/202
6,029,633 A * 2/2000 Brandt ..... 123/509
6,213,100 B1 4/2001 Johansen
6,311,675 B2 11/2001 Crary et al.
6,378,504 B1 * 4/2002 Horiuchi et al. ..... 123/509
6,634,341 B2 10/2003 Crary et al.
6,854,451 B2 2/2005 Ebihara et al.
6,886,542 B2 5/2005 Yamada et al.
6,923,164 B1 * 8/2005 Mitsudou et al. ..... 123/509
6,964,264 B2 * 11/2005 Yoshioka ..... 123/509
2004/0000516 A1 * 1/2004 Okabe et al. ..... 210/416.4
2004/0168678 A1 * 9/2004 Yamada et al. ..... 123/509
2005/0053500 A1 3/2005 Suzuki et al.
2005/0155583 A1 * 7/2005 Mitsudou et al. ..... 123/509

OTHER PUBLICATIONS

Japanese Office Action dated Jun. 2, 2008 and mailed Jun. 4, 2008 in corresponding Japanese Application No. 2005-251333 with English translation.

* cited by examiner

*Primary Examiner*—Mahmoud Gimie
(74) *Attorney, Agent, or Firm*—Nixon & Vanderhye PC

(57) ABSTRACT

A fuel feed apparatus includes a lid member that plugs an opening of a fuel tank. A protruding member protrudes from the lid member into an inside of the fuel tank. A sub-tank is accommodated in the fuel tank. The sub-tank is axially movable relative to the lid member. A pump module is accommodated in the sub-tank. The pump module includes a fuel pump and a fuel filter. The fuel pump pumps fuel from the fuel tank. The fuel filter circumferentially surrounds the fuel pump for removing foreign matters contained in fuel discharged from the fuel pump. A supporting member connects the pump module with the sub-tank. The supporting member extends inwardly with respect to a substantially radial direction of the sub-tank. The supporting member defines a recess on a side of the lid member. The protruding member is adapted to be inserted in the recess.

24 Claims, 6 Drawing Sheets

FUEL FEED APPARATUS HAVING SUB-TANK

CROSS REFERENCE TO RELATED APPLICATIONS

This application is based on and incorporates herein by reference Japanese Patent Application No. 2005-251333 filed on Aug. 31, 2005.

FIELD OF THE INVENTION

The present invention relates to a fuel feed apparatus having a sub-tank.

BACKGROUND OF THE INVENTION

In general, a fuel feed apparatus is received in a fuel tank. The fuel feed apparatus is adapted to stably supplying fuel, even when an amount of fuel remaining in the fuel tank decreases. In recent years, it is required to reduce a fuel tank in height for securing a space for a passenger compartment in a vehicle having the fuel tank. Accordingly, it is also required to reduce a fuel feed apparatus in height corresponding to such a fuel tank accommodating the fuel feed apparatus. A fuel feed apparatus may have a sub-tank accommodating components such as a fuel pump and a fuel filter. Components such as the fuel filter may occupy a large space in the sub-tank. In addition, the fuel feed apparatus may have a lid member having a protruding member extending toward the sub-tank. Accordingly, components such as the fuel pump accommodated in the sub-tank may interfere with the protruding member extending from the lid member due to reduction in height of the fuel feed apparatus. According to U.S. Pat. No. 6,886,542 (JP-A-2004-257347), a protruding member extending from a lid member is accommodated in a remaining space inside a sub-tank.

In this structure disclosed in U.S. Pat. No. 6,886,542, a relatively small connecter protrudes from the lid member, and the connecter is accommodated in the remaining space of the sub-tank. However, in recent years, the protruding member extending from the lid member is apt to be large. Accordingly, when the protruding member is large, it is difficult to accommodate the protruding member in the remaining space inside the sub-tank.

SUMMARY OF THE INVENTION

The present invention addresses the above disadvantage. According to one aspect of the present invention, a fuel feed apparatus is provided to a fuel tank. The fuel feed apparatus includes a lid member that plugs an opening of the fuel tank. The fuel feed apparatus further includes a protruding member that protrudes from the lid member into the fuel tank. The fuel feed apparatus further includes a sub-tank that is accommodated in the fuel tank. The sub-tank is axially movable relative to the lid member. The fuel feed apparatus further includes a pump module that is accommodated in the sub-tank. The pump module includes a fuel pump and a fuel filter. The fuel pump pumps fuel from the fuel tank. The fuel filter circumferentially surrounds at least partially the fuel pump for removing foreign matters contained in fuel discharged from the fuel pump. The fuel feed apparatus further includes at least one supporting member that connects the pump module with the sub-tank. The at least one supporting member inwardly extends in a substantially radial direction of the sub-tank. The at least one supporting member defines a recess on a side of the lid member. The recess is adapted to receiving the protruding member.

Alternatively, a fuel feed apparatus is provided to a fuel tank. The fuel feed apparatus includes a lid member that plugs an opening of the fuel tank. The fuel feed apparatus further includes a protruding member that protrudes from the lid member into the fuel tank. The fuel feed apparatus further includes a sub-tank that is accommodated in the fuel tank. The sub-tank is axially movable relative to the lid member. The fuel feed apparatus further includes a fuel pump that is eccentrically accommodated in the sub-tank for pumping fuel from the fuel tank. The fuel feed apparatus further includes a supporting member that extends from a sidewall of the sub-tank to the fuel pump in a substantially radial direction of the sub-tank. The supporting member defines a recess on a side of the lid member for receiving the protruding member.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Embodiment

Figure 1:
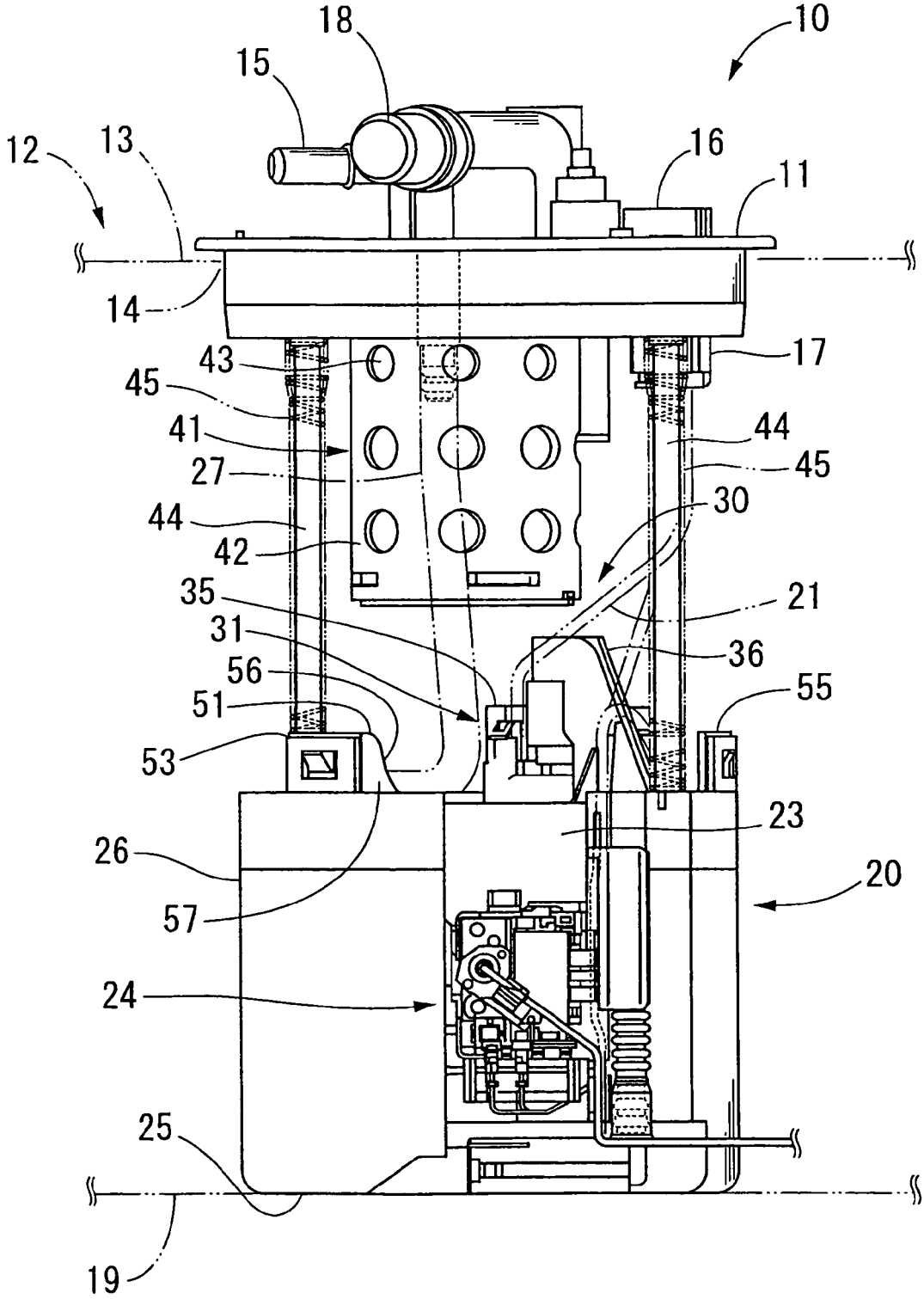
FIG. 1 is a longitudinal view showing a fuel feed apparatus according to an embodiment.
Figure 2:
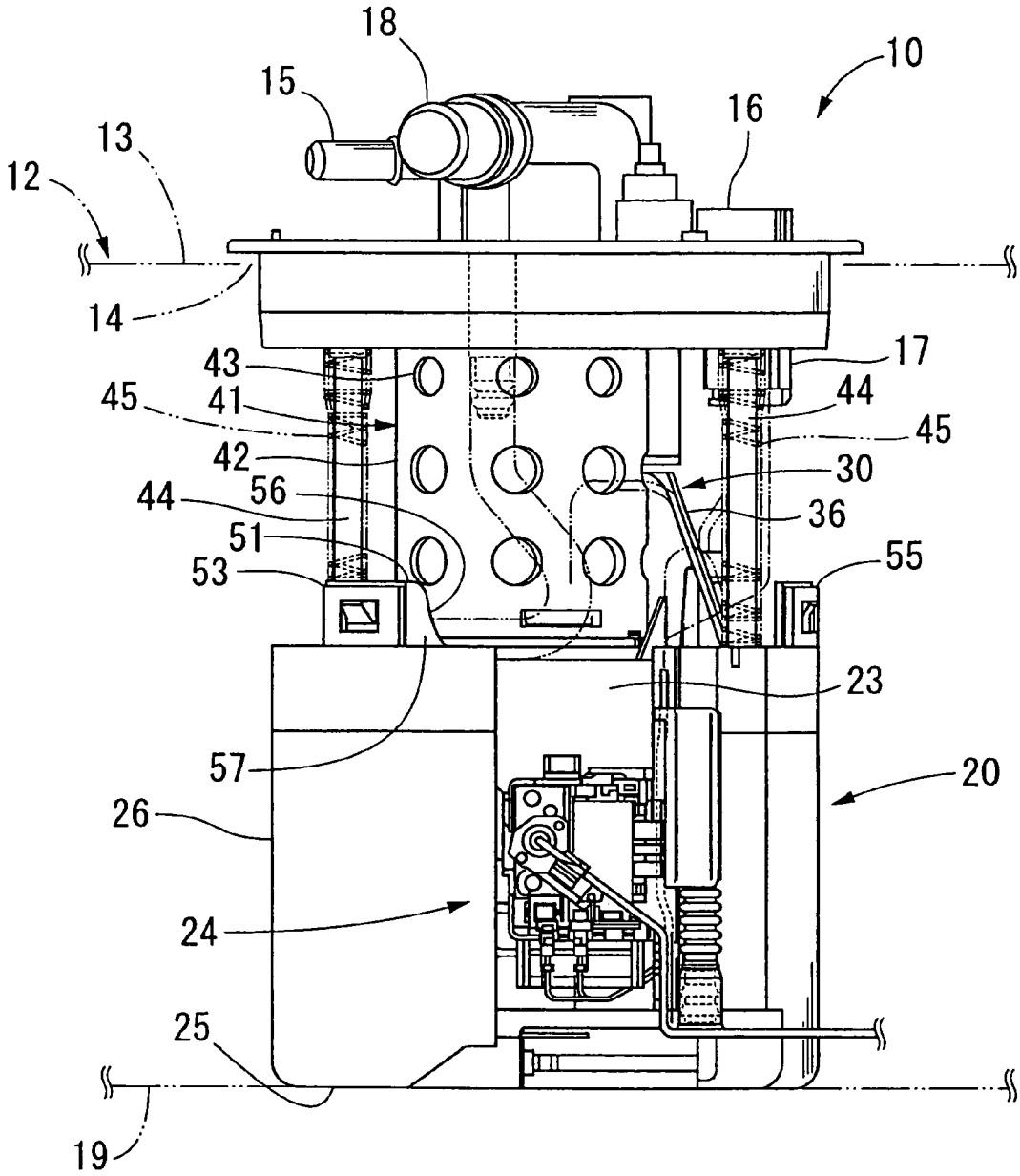
FIG. 2 is a longitudinal partially sectional view showing the fuel feed apparatus, in which a flange is located in the vicinity of a sub-tank.

As shown in FIGS. 1, 2, a fuel feed apparatus 10 has a flange 11 as a lid member. The flange 11 is formed of resin to be in a substantially disc-shape, for example. The flange 11 is provided to an opening 14 formed in an upper wall 13 of a fuel tank 12. The flange 11 covers the opening 14. Components of the fuel feed apparatus 10 excluding the flange 11 are accommodated in the fuel tank 12. The fuel tank 12 is formed of resin, for example. The fuel feed apparatus 10 includes the flange 11 and a sub-tank 20. The flange 11 is attached to the fuel tank 12. The sub-tank 20 is accommodated in the fuel tank 12, as being supported by the flange 11. The sub-tank 20 accommodates the pump module 30.

The flange 11 includes an outlet pipe 15 and an electric connector 16. The outlet pipe 15 introduces fuel discharged from a fuel pump 31 of the pump module 30 to the outside of the fuel tank 12. The electric connector 16 connects with an electric power source and an ECU (not shown). The flange 11 has a connector 17 that protrudes toward the sub-tank 20. The connector 17 electrically connects with the electric connector 16. A lead wire 21 extends from the connector 17 toward the fuel pump 31. The electric power source supplies electricity to the fuel pump 31 through the lead wire 21.

Figure 3:
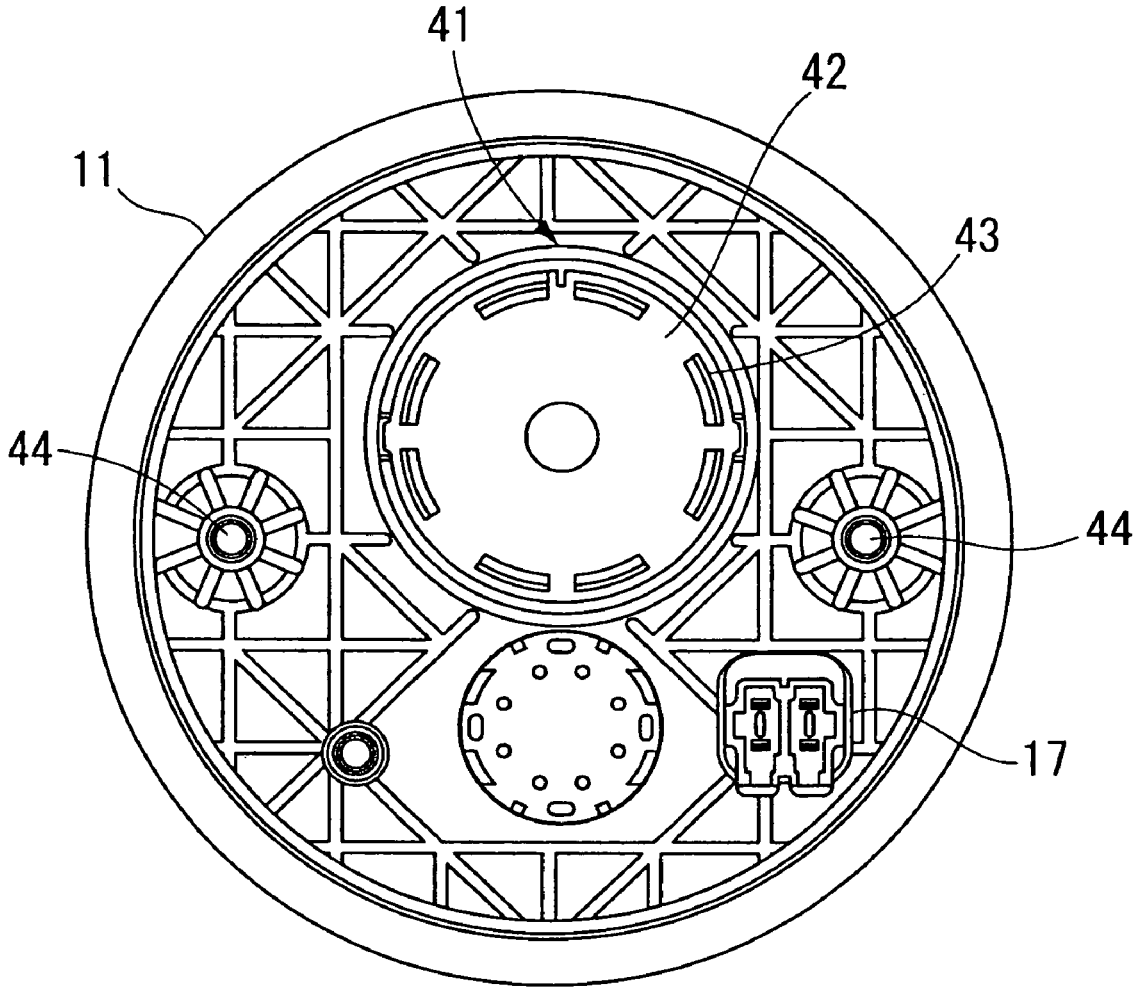
FIG. 3 is a view showing the flange when being viewed from the sub-tank.

The flange 11 includes a float valve (protruding member) 41 that protrudes toward the sub-tank 20. The float valve 41 includes a casing 42 that accommodates a component such as a float (not shown). The float valve 41 is provided to a tank passage that communicates the interior of the fuel tank 12 with a canister (not shown) outside the fuel tank 12. The float valve 41 detects liquid level of fuel received in the fuel tank 12. When an amount of the fuel in the fuel tank 12 is greater than a predetermined amount, the unillustrated float blocks the passage communicating with a tank pipe 18. Thus, air discharged from the fuel tank 12 to the outside is blocked, so that supplying fuel into the fuel tank 12 is terminated. The casing 42 of the float valve 41 is formed of resin, for example. The casing 42 is provided to the flange 11 by engagement, for example. The casing 42 has an opening 43 through which the interior of the casing 42 communicates with the interior of the fuel tank 12. As shown in FIGS. 1, 3, the casing 42 is in a substantially cylindrical shape.

The protruding member is not limited to the float valve 41. The protruding member may be a pressure control valve that controls pressure in the fuel tank 12. The pressure control valve opens when pressure in the fuel tank 12 becomes greater than a predetermined pressure, so that fuel vapor evaporated in the fuel tank 12 can be exhausted to the canister. Thus, pressure in the fuel tank 12 can be reduced. Vapor fuel passing through the pressure control valve flows to the canister.

Figure 4:
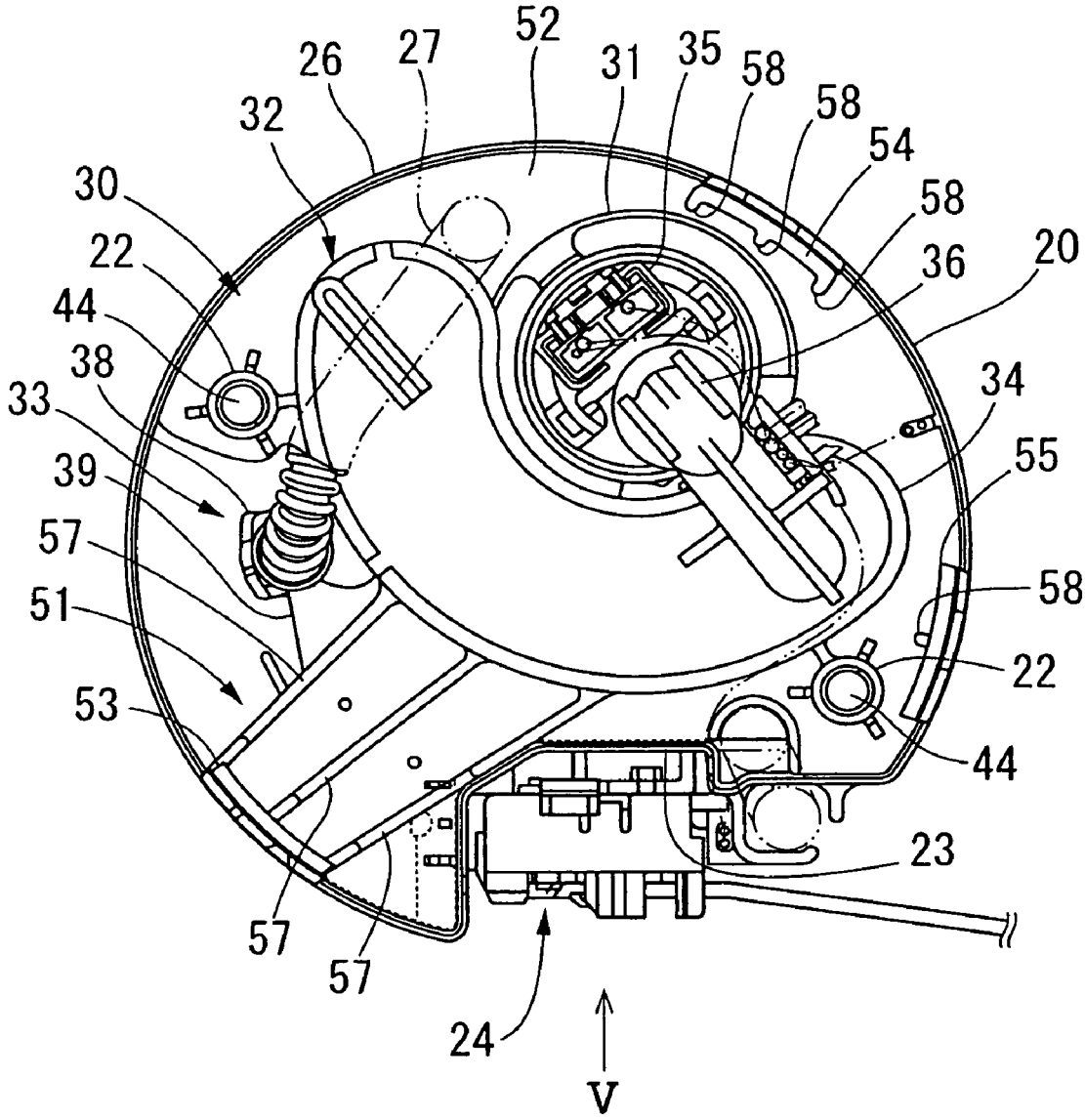
FIG. 4 is a view showing the sub-tank when being viewed from the flange.

As referred to FIGS. 1, 2, the flange 11 connects with the sub-tank 20 via shafts 44. As referred to FIG. 3, the shafts 44 are press-inserted into the flange 11 at one ends. As shown in FIG. 4, the shafts 44 are inserted loosely into joint members 22 that are provided to the sub-tank 20. The joint members 22 are provided to both radially ends of the sub-tank 20. The joint members 22 protrude in the sub-tank 20. A spring 45 is provided around the outer periphery of each shaft 44. The spring 45 serves as a bias member.

The spring 45 biases the flange 11 and the sub-tank 20 such that the flange 11 and the sub-tank 20 are spaced from each other. Thus, the flange 11 and the sub-tank 20, which accommodates the pump module 30, are movable relatively to each other substantially in the axial direction of the flange 11, i.e. in a vertical direction in FIG. 1. Thus, as referred to FIGS. 1, 2, the distance between the flange 11 and the sub-tank 20 is adjustable, i.e., the height of the fuel feed apparatus 10 is adjustable. In this structure, the sub-tank 20 is regularly pressed onto a bottom wall 19 of the fuel tank 12 by bias force of the springs 45, even when the fuel tank 12 expands or shrinks due to variation in pressure in the fuel tank 12 caused by change in temperature and variation in an amount of fuel received in the fuel tank 12.

As shown in FIG. 4, the sub-tank 20 is in a substantially arc cylindrical shape. The sub-tank 20 has a flat plane (flat wall) 23 partially in the circumferential periphery. The flat plane 23 is provided with a sender gauge 24 that detects the amount of fuel in the fuel tank 12. The sub-tank 20 has a bottom portion 25 and a side portion 26. The side portion 26 partially defines the sidewall of the sub-tank 20. The side portion 26 is in a substantially cylindrical shape. The side portion 26 extends from the bottom portion 25 toward the flange 11. The flat plane 23 partially occupies the side portion 26. The sub-tank 20 receives fuel drawn from the fuel tank 12 using a jet pump (not shown).

Figure 5:
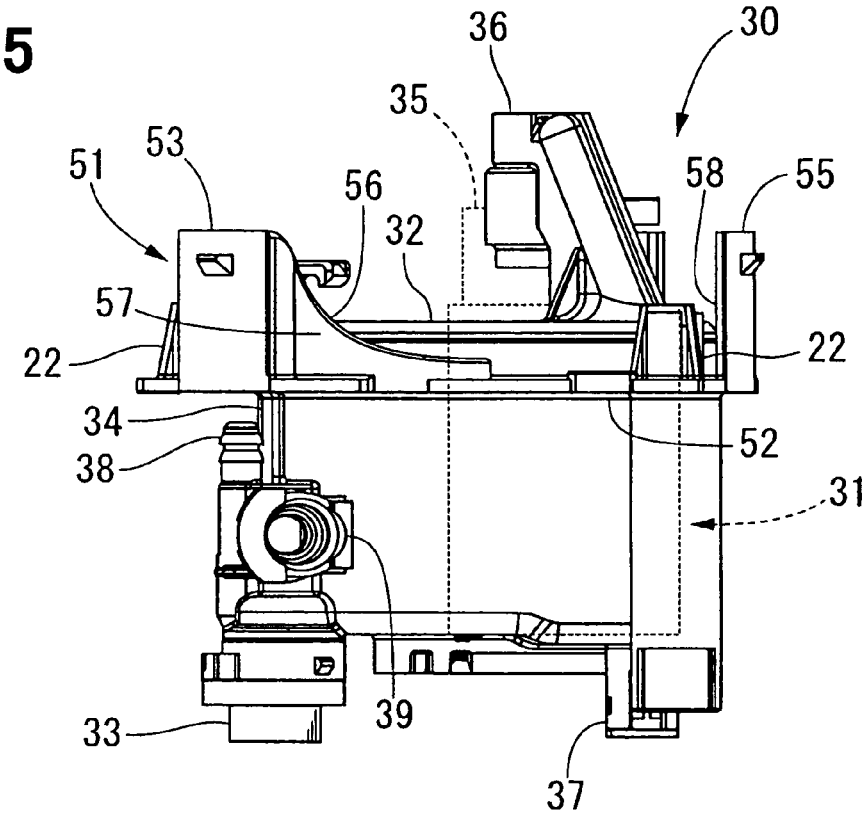
FIG. 5 is a view showing a pump module, which is accommodated in the sub-tank, when being viewed from the arrow V in FIG. 4.

The sub-tank 20 accommodates the pump module 30. As shown in FIGS. 4, 5, the pump module 30 includes the fuel pump 31, a fuel filter 32, and a pressure regulator 33. The fuel filter 32 includes a filter case 34 that accommodates a filter element (not shown). As referred to FIG. 4, the fuel filter 32 is located on the radially outer side of the fuel pump 31 such that the fuel filter 32 partially surrounds the circumferential periphery of the fuel pump 31. In this structure, the fuel filter 32 is in a substantially arc shape, i.e., a substantially crescent shape. The fuel filter 32 removes relatively small foreign matters contained in fuel discharged from the fuel pump 31.

The fuel pump 31 is vertically accommodated in the sub-tank 20 in the condition shown in FIG. 5. That is, the fuel outlet of the fuel pump 31 is arranged on the upper side with respect to the direction of gravitational force. The fuel inlet of the fuel pump 31 is arranged on the lower side with respect to the direction of gravitational force. As referred to FIG. 1, the fuel pump 31 has a connector 35 that electrically connects with the connector 17 via the lead wire 21. The connector 35 is adjacent to an outlet 36 through which the fuel pump 31 discharges fuel. The fuel pump 31 includes a motor and a rotor (not shown). The fuel pump 31 draws fuel by rotating the rotor such as an impeller together with the motor. The fuel pump 31 has an inlet 37 that is provided with a suction filter (not shown). The suction filter removes relatively large foreign matters contained in fuel drawn into the fuel pump 31.

The pressure regulator 33 is provided to the filter case 34. The fuel pump 31 discharges fuel through the outlet 36, and the discharged fuel flows into the pressure regulator 33 through the fuel filter 32, so that the fuel flowing into the pressure regulator 33 is controlled in pressure. The pressure-controlled fuel is discharged toward the outlet pipe 15 of the flange 11 through an exhaust port 38 (FIG. 4) and a fuel pipe 27 connecting with the exhaust port 38 as referred to FIG. 1. When the pressure regulator 33 controls pressure of fuel, the pressure regulator 33 exhausts surplus fuel, and the surplus fuel is supplied into a jet pump (not shown) through an exhaust port 39.

As shown in FIG. 4, the fuel pump 31 of the pump module 30 is arranged eccentrically with respect to the center axis of the sub-tank 20. The fuel pump 31 has a lateral portion adjacent to the side portion 26 of the sub-tank 20, so that the lateral portion of the fuel pump 31 and the sub-tank 20 do not interpose the fuel filter 32 therebetween. The fuel filter 32 is in the substantially arc shape. Therefore, the fuel pump 31 can be arranged closely to the side portion 26 of the sub-tank 20.

The pump module 30 is supported by the sub-tank 20 via supporting members 51, 52. The fuel pump 31 of the pump module 30 is arranged eccentrically with respect to the sub-tank 20. The supporting member 51 is longer than the supporting member 52 with respect to the radial direction of the sub-tank 20. The supporting member 51 serves as a long supporting member. The supporting member 51 connects with the filter case 34 at one end. The supporting member 51 is mounted to the sub-tank 20 at the other end. The supporting member 51 has an engaging portion 53 in the end on the side of the sub-tank 20. The engaging portion 53 is fixed to the sub-tank 20 by snap fitting, for example.

The supporting member 52 is in a substantially arc shape. The supporting member 52 surrounds the peripheries of the fuel pump 31 and the fuel filter 32. The supporting member 52 partially blocks the end of the sub-tank 20 on the side of the flange 11. The supporting member 52 has an engaging portion 54. The engaging portion 54 is located on a substantially opposite side of the engaging portion 53 of the supporting member 51 with respect to the fuel pump 31. The supporting member 52 has an engaging portion 55 that is spaced from the engaging portion 54 with respect to the circumferential direction of the sub-tank 20 for a predetermined distance. The supporting member 52 is fixed to the sub-tank 20 by engaging such as snap fitting the engaging portions 54, 55 to the sub-tank 20. The engaging portion 53 of the supporting member 51 and the engaging portions 54, 55 of the supporting member 52 are engaged with the sub-tank 20, so that the pump module 30 is supported by the sub-tank 20.

The supporting member 51 connects the sub-tank 20 with the pump module 30. As shown in FIG. 5, the supporting member 51 is provided to the ends of the sub-tank 20 and the pump module 30 on the side of the flange 11. Accordingly, when the flange 11 moves to the vicinity of the sub-tank 20, the supporting member 51 may interfere with the float valve 41 that protrudes from the flange 11 toward the sub-tank 20. Therefore, the supporting member 51 has a recess 56 in which the surface of the supporting member 51 on the side of the flange 11 concaves to the opposite side of the flange 11.

Figure 6:
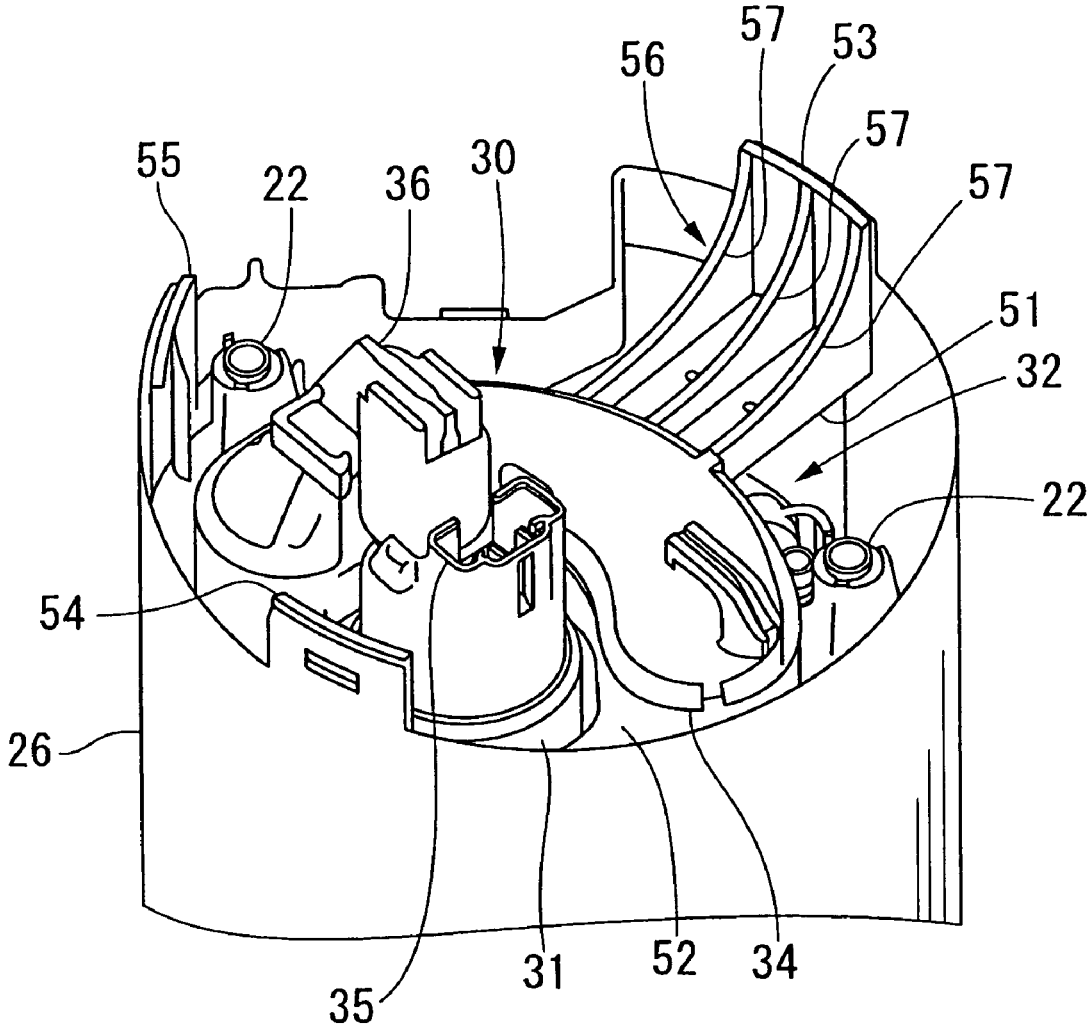
FIG. 6 is a view showing the end of the sub-tank on the side of the flange.

The fuel pump 31 of the pump module 30 is arranged eccentrically with respect to the sub-tank 20. In this structure, vibration of the pump module 30 may be nonuniformly transmitted to the supporting members 51, 52. Particularly, the supporting member (long supporting member) 51 having the large length may be applied with large force from the eccentrically arranged pump module 30. Consequently, the supporting member 51 may be bent. In this condition, the supporting member 51 may amplify specific frequency of vibration because of causing the bent. Therefore, in this example embodiment as referred to FIGS. 4 to 6, the supporting member 51 has ribs 57. The ribs 57 extend substantially in the radial direction of the sub-tank 20. That is, the ribs 57 extend substantially along the direction in which the supporting member 51 extends. The ribs 57 extend toward the flange 11. The ribs 57 are arranged along the circumferential direction of the sub-tank 20. In this example embodiment, the number of the ribs is three. The ribs 57 extend toward the flange 11. Accordingly, in this structure, the ribs 57 may interfere with the float valve 41 that protrudes from the flange 11 toward the sub-tank 20. Therefore, the ribs 57 have the recess 56 in which the surface of the ribs 57 on the side of the flange 11 concaves to the opposite side of the flange 11. Thus, as shown in FIG. 2, when the distance between the flange 11 and the sub-tank 20 is short, the float valve 41 protruding from the flange 11 can be inserted, i.e., received in the recess 56 defined by the ribs 57, as restricting interference with the pump module 30. As referred to FIG. 5, ribs 58 may be provided in the vicinity of the engaging portions 54, 55 of the supporting member 52.

The fuel pump 31 of the pump module 30 has the outlet 36 located at the end of the fuel pump 31 on the side of the flange 11. The outlet 36 protrudes toward the flange 11 beyond the end of the fuel filter 32 on the side of the flange 11. In this structure, the fuel pump 31 and the fuel filter 32 define a gap therebetween. The fuel pump 31 protrudes toward the flange 11. As referred to FIGS. 1, 2, the outlet 36 of the fuel pump 31 protrudes toward the flange 11 beyond the end of the sub-tank 20 on the side of the flange 11. The fuel pump 31 is eccentric with respect to the sub-tank 20. In addition, the fuel pump 31 protrudes toward the flange 11 beyond the fuel filter 32 and the sub-tank 20. Thus, in this structure, as referred to FIGS. 4, 5, the sub-tank 20 defines a space therein on the side of the supporting member 51 with respect to the fuel pump 31. That is, allowance of space can be produced in the sub-tank 20 on the side in which the fuel pump 31 is not provided. The allowance of space is produced on the side of the supporting member 51.

Thus, the allowance of space can be secured in the sub-tank 20 by arranging the fuel pump 31 eccentrically in the sub-tank 20. In addition, the ribs 57 of the supporting member 51 are located on the side of the space. The ribs 57 define the recess 56, so that the flange 11 and the sub-tank 20 can secure the space therebetween such that the float valve 41 can be inserted into the space. Consequently, as referred to FIG. 2, the float valve 41 can be restricted from causing interference with the pump module 30 on the side of the sub-tank 20 when the flange 11 is in the vicinity of the sub-tank 20, even a large component such as the float valve 41 protrudes from the flange 11. Therefore, the height of the fuel feed apparatus 10 can be reduced, even a large component such as the float valve 41 is provided to the fuel feed apparatus 10.

In the structure, in which the fuel tank 12 of the pump module 30 is arranged eccentrically with respect to the sub-tank 20, vibration may be amplified at specific frequency due to transmission of nonuniform vibration between the supporting members 51, 52. Vibration may be amplified at specific frequency due to difference between rigidity of the supporting members 51, 52 that connect the pump module 30 with the sub-tank 20. In this example embodiment, the supporting members 51, 52, the ribs 57 provided to the supporting member 51, and the ribs 58 provided to the supporting member 52 are adjusted in shape, so that vibration is reduced at specific frequency.

When rigidity of the supporting member 51 is low, vibration may be amplified at specific frequency. Therefore, the length of the supporting member 51 with respect to the circumferential direction of the sub-tank 20 is large on the side of the pump module 30. That is, the width of the supporting member 51 is large on the side of the pump module 30 to enhance rigidity of the supporting member 51. The width of the supporting member 51 is small on the side of the side portion 26 of the sub-tank 20. Force applied from the pump module 30 to the supporting member 51 is large at both the end on the side of the pump module 30 and the end of the side of the sub-tank 20. In this structure, the width of the supporting member 51 on the side of the pump module 30 is large, so that rigidity of the supporting member 51 can be enhanced.

As the width of the supporting member 51 increases, the supporting member 51 can be enhanced in rigidity. Therefore, the width of the supporting member 51 is preferably large uniformly from the vicinity of the pump module 30 toward the sub-tank 20. However, the width of the supporting member 51 needs to be small on the side of the sub-tank 20 for restricting interference with the flat plane 23 of the sub-tank 20 and for securing a space in the sub-tank 20. In this structure, the supporting member 51 is reduced in width on the side of the side portion 26 of the sub-tank 20, so that the supporting member 51 can be readily installed in the sub-tank 20.

As the width of the supporting member 51 decreases, rigidity of the supporting member 51 is reduced. The end of the supporting member 51 on the side of the sub-tank 20 is provided with the engaging portion 53. The engaging portion 53 is apt to be inclined with respect to the supporting member 51. Consequently, rigidity of the engaging portion 53 may be impaired, and vibration may be increased. In this structure, the supporting member 51 has the ribs 57 raised toward the flange 11. Force is applied to the supporting member 51 largely in the vicinity of the side portion 26 of the sub-tank 20. Therefore, the ribs 57 are raised toward the flange 11 largely in the vicinity of the side portion 26 of the sub-tank 20. That is, the height of the ribs 57 is large in the vicinity of the side portion 26 of the sub-tank 20.

The height of the ribs 57 is preferably large throughout the supporting member 51 to enhance rigidity of the supporting member 51. However, the ribs 57 need to define the recess 56 to restrict interference with the float valve 41 that protrudes from the flange 11. The supporting member 51 is apt to be applied with large force in the vicinity of the side portion 26. Accordingly, the structure of the supporting member 51 in the vicinity of the side portion 26 has a large influence with respect to rigidity of the supporting member 51. Therefore, the height of the ribs 57 is defined to be greater toward the side portion 26, so that both rigidity of the supporting member 51 and the space, which is defined by the recess 56 for accommodating the float valve 41, can be secured. The number of the ribs 57 is preferably large to enhance rigidity of the supporting member 51. However, as the number of the ribs 57 becomes large, increase in enhancement of rigidity may become small in the supporting member 51 even additional ribs 57 are further provided. Accordingly, the number of the ribs 57 is preferably determined in accordance with the width of the supporting member 51.

Figure 7:
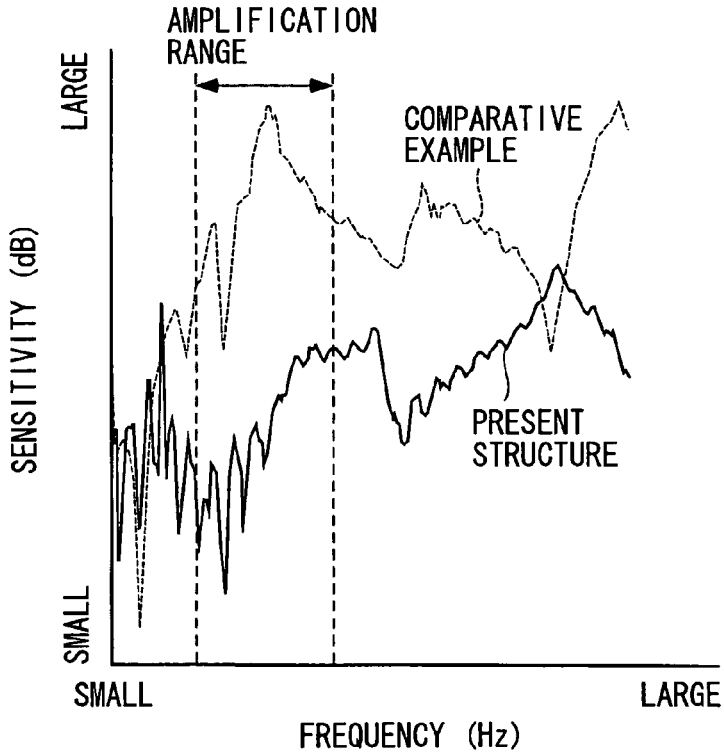
FIG. 7 is a graph showing a relationship between frequency of vibration and sensitivity of the pump module about the vibration.

Rigidity of the supporting member 51 can be enhanced by determining combination among the shape of the supporting member 51, the shape of the ribs 57, and the number of the ribs 57. In addition, difference in rigidity between the supporting members 51, 52 can be also reduced. Vibration at specific frequency can be reduced by adjusting the shapes of the supporting member 51 and the ribs 57. As shown in FIG. 7, vibration caused by the pump module 30 can be reduced at specific frequency by optimizing combination between the shapes of the supporting member 51 and the ribs 57. In FIG. 7, the sensitivity of the pump module 30 is related to amplification of vibration. The present structure in FIG. 7 represents an example structure, in which the supporting members 51, 52 are substantially optimized in configuration such as shape. The comparative example in FIG. 7 represents a structure, in which supporting members without the ribs 57, 58 connect the pump module 30 with the sub-tank 20. In this comparative example, the supporting members are not optimized in shape. In the specific amplification range of frequency in FIG. 7, the sensitivity of the pump module 30 of the present structure is reduced compared with the sensitivity of the comparative example. Therefore, in the present structure, amplification of vibration and noise can be restricted, even the fuel pump 31 of the pump module 30 is eccentrically arranged.

In the above structure, the center axis of the pump module 30 is spaced from the center axis of the sub-tank 20. Therefore, the sub-tank 20 is partially in the vicinity of the pump module 30 on one side, and is partially spaced from the pump module 30 on the other side. An allowance of the space can be secured in the location in which the sub-tank 20 is spaced from the pump module 30. The recess 56 is arranged in the location in which the sub-tank 20 is spaced from the pump module 30, so that the space for accommodating the float valve 41 can be secured in the sub-tank 20 on the side of the flange 11. Thus, a component on the side of the flange 11 can be restricted from causing interference with a component on the side of the sub-tank 20, so that the height of the fuel feed apparatus 10 can be reduced.

The fuel filter 32 is in the substantially arc-shape, so that the fuel pump 31 is partially out of surrounding of the fuel filter 32. The sidewall of the sub-tank 20 is faced to the side of fuel pump 31, which is out of the surrounding of the fuel filter 32, so that the pump module 30 can be arranged closely to the sub-tank 20. Thus, the center axis of the pump module 30 can be arranged distant from the center axis of the sub-tank 20. In this structure, a component on the side of the flange 11 can be restricted from causing interference with a component on the side of the sub-tank 20, so that the height of the fuel feed apparatus 10 can be reduced.

In the above structure, the end of the fuel pump 31 on the side of the flange 11 protrudes beyond the fuel filter 32, so that the fuel filter 32 and the fuel pump 31 define a step therebetween in the pump module 30. The cross section of the fuel pump 31 is smaller than the cross section of the fuel filter 32, so that the fuel pump 31 does not occupy a large space around the end of the sub-tank 20 on the side of the flange 11, even the fuel pump 31 protrudes toward the flange 11. Therefore, a large space can be secured around the fuel pump 31, so that the space for accommodating the float valve 41 can be secured around the fuel pump 31.

The end of the fuel pump 31 on the side of the flange 11 protrudes beyond the sub-tank 20, so that a large space can be secured around the fuel pump 31 for accommodating the float valve 41.

The float valve 41 detects whether fuel supplied into the fuel tank 12 is equal to or greater than a predetermined mount. The float valve 41 protrudes from the flange 11 into the fuel tank 12. Therefore, the float valve 41 occupies a large space with respect to the radial and axial directions of the flange 11. In the above structure, a large space can be secured on the side of the sub-tank 20, so that the float valve 41, which has a large volume, can be sufficiently received in the large space secured in the sub-tank 20.

The supporting members 51, 52 are provided to both radially substantially opposite sides such that the supporting members 51, 52 interpose the fuel pump 31 therebetween. Therefore, the pump module 30 including the fuel pump 31 can be stably supported by the sub-tank 20.

The float valve 41 protruding from the flange 11 is inserted into a location spaced from the pump module 30. Therefore, when the length of the supporting member 51 is large, it may be difficult to secure the space for accommodating the float valve 41. Force applied to the supporting member 51 is large in the vicinity of the base of the supporting member 51 on the side of the pump module 30. In the above structure, the width of the supporting member 51 is large on the radially inner side of the supporting member 51. The radially inner side of the supporting member 51 is a base portion of the supporting member 51 to which large force is applied. The width of the supporting member 51 is small on the radially outer side on which the space needs to be secured for accommodating the float valve 41. Thus, in the above structure of the supporting member 51, both rigidity of the supporting member 51 and the space for accommodating the float valve 41 can be produced. Rigidity of the supporting member 51 can be readily adjusted by modifying the number and the shape of the ribs 57.

The ribs 58 may be provided to the supporting member 52 in addition to or instead of the supporting member 51. In this structure, rigidity of the supporting members 51, 52 can be entirely enhanced. Thus, amplification of vibration and noise of the pump module 30 can be further suppressed.

Modified Embodiment

In the above example embodiment, the flange 11 is provided with the float valve 41. The protruding member provided to the flange 11 is not limited to the float valve 41. The protruding member may be any other component such as the pressure control valve and the canister.

Various modifications and alternations may be diversely made to the above embodiments without departing from the spirit of the present invention.

What is claimed is:

1. A fuel feed apparatus configured to be provided in a fuel tank, the fuel feed apparatus comprising:

a lid member configured to plug an opening of the fuel tank;

a protruding member configured to protrude from the lid member into the fuel tank;

a sub-tank configured to be accommodated in the fuel tank and axially movable relative to the lid member;

a pump module accommodated in the sub-tank, the pump module including a fuel pump for pumping fuel from the fuel tank, the pump module further including a fuel filter, which circumferentially surrounds at least partially the fuel pump for removing foreign matters contained in fuel discharged from the fuel pump; and a plurality of supporting members that connect the pump module with the sub-tank, wherein the plurality of supporting members inwardly extend in a substantially radial direction of the sub-tank, at least one of the plurality of supporting members defines a recess on a side of the lid member for receiving the protruding member, two of the plurality of supporting members are substantially opposite to each other with respect to a radial direction of the fuel pump and interpose the fuel pump therebetween, and the two supporting members include a long supporting member that has a radially outer end and a radially inner end and extends from the pump module to the sub-tank for a length that is greater than a length of an other of the two supporting members.

2. The fuel feed apparatus according to claim 1, wherein the pump module is eccentrically accommodated in the sub-tank, and the recess is located in a space, in which distance between a sidewall of the sub-tank and the pump module is large.

3. The fuel feed apparatus according to claim 2, wherein the fuel filter is in a substantially arc shape, and the fuel filter partially surrounds a circumferential periphery of the fuel pump.

4. The fuel feed apparatus according to claim 1, wherein the fuel pump has an end on a side of the lid member, the fuel filter has an end on a side of the lid member, and the end of the fuel pump is in the vicinity of the lid member compared with the end of the fuel filter.

5. The fuel feed apparatus according to claim 1, wherein the fuel pump has an end on a side of the lid member, the sub-tank has an end on a side of the lid member, and the end of the fuel pump is in the vicinity of the lid member compared with the end of the sub-tank.

6. The fuel feed apparatus according to claim 1, wherein the protruding member is a float valve for detecting liquid level in the fuel tank.

7. The fuel feed apparatus according to claim 1, wherein radially outer end has a width with respect to a circumferential direction of the sub-tank, the radially inner end has a width with respect to the circumferential direction of the sub-tank, and the width of the radially outer end is less than the width of the radially inner end.

8. The fuel feed apparatus according to claim 7, wherein the radially outer end has at least one rib that extends toward the lid member, and the at least one rib defines the recess.

9. The fuel feed apparatus according to claim 8, wherein the at least one rib includes a plurality of ribs, each of the plurality of ribs extends substantially in a radial direction of the sub-tank, and the plurality of ribs are arranged along the circumferential direction of the sub-tank.

10. The fuel feed apparatus according to claim 1, wherein the pump module is eccentrically accommodated in the sub-tank, and the recess is located on a substantially opposite side of the fuel pump with respect to the fuel filter.

11. The fuel feed apparatus according to claim 1, wherein the pump module has a center axis that is spaced from a center axis of the sub-tank, and the recess is located on a substantially opposite side of the center axis of the pump module with respect to the center axis of the sub-tank.

12. The fuel feed apparatus according to claim 1, wherein the pump module has an end on the side of the lid member, and the end of the pump module is adjacent to the protruding member with respect to a radial direction of the sub-tank when the protruding member is at least partially received in the recess.

13. The fuel feed apparatus according to claim 1, further comprising:

a plurality of shafts that connect the sub-tank with the lid member, wherein the sub-tank includes a plurality of joint members to which the two shafts are movably inserted, and the plurality of joint members are located on an outer side of the pump module with respect to the radial direction of the sub-tank.

14. The fuel feed apparatus according to claim 13, wherein the plurality of joint members includes two joint members, one of the two joint members is located on a substantially opposite side of an other of the two joint members with respect to a radial direction of the sub-tank, and the two joint members at least partially interpose the pump module therebetween.

15. The fuel feed apparatus according to claim 1, wherein the sub-tank has a sidewall that is substantially arc in axial section, the sub-tank has a flat plane that is substantially linear in axial section, and the axial section of the flat plane defines a chord of the axial section of the sidewall.

16. The fuel feed apparatus according to claim 15, further comprising:

a sender gauge that is provided to the flat plane for detecting an amount of fuel in the fuel tank.

17. The fuel feed apparatus according to claim 1, wherein the plurality of supporting members directly connects the pump module with the sub-tank, and the pump module is supported by the sub-tank via the plurality of supporting members.

18. The fuel feed apparatus according to claim 1, wherein the long supporting member defines the recess on the side of the lid member for receiving the protruding member.

19. A fuel feed apparatus configured to be provided in a fuel tank, the fuel feed apparatus comprising:

a lid member configured to plug an opening of the fuel tank;

a protruding member configured to protrude from the lid member into the fuel tank;

a sub-tank configured to be accommodated in the fuel tank and axially movable relative to the lid member;

a fuel pump eccentrically accommodated in the sub-tank for pumping fuel from the fuel tank; and a plurality of supporting members, each extending from a sidewall of the sub-tank to the fuel pump in a substantially radial direction of the sub-tank, wherein at least one of the plurality of supporting members defines a recess on a side of the lid member for receiving the protruding member, the plurality of supporting members inwardly extends in a substantially radial direction of the sub-tank, two of the plurality of supporting members are substantially opposite to each other with respect to a radial direction of the fuel pump and interpose the fuel pump therebetween, and the two supporting members include a long supporting member that has a radially outer end and a radially inner end and extends from the pump module to the sub-tank for a length that is greater than a length of an other of the two supporting members.

20. The fuel feed apparatus according to claim 19, further comprising:

a fuel filter that at least partially surrounds a circumferential periphery of the fuel pump for removing foreign matters contained in fuel discharged from the fuel pump, wherein the recess is located on a substantially opposite side of the fuel pump with respect to the fuel filter.

21. The fuel feed apparatus according to claim 20, wherein the supporting member supports the fuel pump via the fuel filter.

22. The fuel feed apparatus according to claim 19, wherein the fuel pump has an end on the side of the lid member, and the end of the fuel pump is adjacent to the protruding member with respect to a radial direction of the sub-tank when the protruding member is at least partially received in the recess.

23. The fuel feed apparatus according to claim 19, wherein the plurality of supporting members directly connect the pump module with the sub-tank, and the pump module is supported by the sub-tank via the plurality of supporting members.

24. The fuel feed apparatus according to claim 19, wherein the long supporting member defines the recess on the side of the lid member for receiving the protruding member.

* * * * *